US011578930B2

(12) United States Patent
Nakamura et al.

(10) Patent No.: US 11,578,930 B2
(45) Date of Patent: Feb. 14, 2023

(54) HEAT EXCHANGER, HEAT EXCHANGER UNIT, AND REFRIGERATION CYCLE APPARATUS

(71) Applicant: Mitsubishi Electric Corporation, Tokyo (JP)

(72) Inventors: Shin Nakamura, Tokyo (JP); Tsuyoshi Maeda, Tokyo (JP); Akira Yatsuyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 171 days.

(21) Appl. No.: 17/059,795

(22) PCT Filed: Jul. 27, 2018

(86) PCT No.: PCT/JP2018/028272
§ 371 (c)(1),
(2) Date: Nov. 30, 2020

(87) PCT Pub. No.: WO2020/021706
PCT Pub. Date: Jan. 30, 2020

(65) Prior Publication Data
US 2021/0207900 A1 Jul. 8, 2021

(51) Int. Cl.
*F28F 17/00* (2006.01)
*F25B 39/00* (2006.01)
(Continued)

(52) U.S. Cl.
CPC ..... *F28F 17/005* (2013.01); *F25B 39/00* (2013.01); *F28F 1/325* (2013.01); *F25B 39/02* (2013.01)

(58) Field of Classification Search
CPC ..... F28F 17/005; F28F 1/325; F25B 39/00; F24F 13/222; F28B 9/08
See application file for complete search history.

(56) References Cited

U.S. PATENT DOCUMENTS

2019/0049185 A1* 2/2019 Ito ..... F28D 1/05308

FOREIGN PATENT DOCUMENTS

CN 105057901 A * 11/2015
CN 105057901 A 11/2015
(Continued)

OTHER PUBLICATIONS

Attached pdf is translation of foreign reference CN105057901A (Year: 2015).*
Attached pdf is translation of foreign reference WO2017221303A1 (Year: 2017).*
(Continued)

*Primary Examiner* — Len Tran
*Assistant Examiner* — Kamran Tavakoldavani
(74) *Attorney, Agent, or Firm* — Posz Law Group, PLC

(57) ABSTRACT

A heat exchanger, a heat exchanger unit, and a refrigeration cycle apparatus improve a heat exchange performance, a discharge performance, and a frosting resistance, and each include: a flat tube; a fin formed in the shape of a plate having a plate surface extending in a longitudinal direction of the fin that is perpendicular to a width direction thereof, coincides with an up/down direction, and crosses the tube axis of the flat tube; and a first water conveyance member provided below the fin. The first water conveyance member has: a first upper surface facing a lower end portion of the fin; a first ridge located at one end portion of the first upper surface; and a second ridge located at the other end portion of the first upper surface.

17 Claims, 19 Drawing Sheets

(51) Int. Cl.
*F28F 1/32* (2006.01)
*F25B 39/02* (2006.01)

(56) References Cited

FOREIGN PATENT DOCUMENTS

| | | | | |
|---|---|---|---|---|
| EP | 3534103 | A1 | | 9/2019 |
| JP | S54-80656 | U | | 6/1979 |
| JP | S61-48811 | U | | 4/1986 |
| JP | H0313794 | A | * | 1/1991 |
| JP | 2000-046375 | A | | 2/2000 |
| JP | 2010-139166 | A | | 6/2010 |
| JP | 5464207 | B2 | | 4/2014 |
| JP | 2015-055401 | A | | 3/2015 |
| WO | 2016/056076 | A1 | | 4/2016 |
| WO | 2017/183180 | A1 | | 10/2017 |
| WO | 2017/221303 | A1 | | 12/2017 |
| WO | WO-2017221303 | A1 | * | 12/2017 ..... F25B 39/02 |
| WO | 2018078800 | A1 | | 5/2018 |

OTHER PUBLICATIONS

Attached pdf is translation of foreign reference JPH0313794 (Year: 1991).*
Pdf file is translation of foreign reference JPH 0313794A (Year: 1991).*
International Search Report of the International Searching Authority dated Oct. 9, 2018 for the corresponding International application No. PCT/JP2018/028272 (and English translation).
Office Action dated Jan. 4, 2022 issued irs corresponding CN patent application No. 201880095254.2 (and English translation).
Extended European Search Report dated Jul. 1, 2021, issued in corresponding European Patent Application No. 18927913.6.

* cited by examiner

Comparative Example

Comparative Example

HEAT EXCHANGER, HEAT EXCHANGER UNIT, AND REFRIGERATION CYCLE APPARATUS

CROSS REFERENCE TO RELATED APPLICATION

This application is a U.S. national stage application of PCT/JP2018/028272 filed on Jul. 27, 2018, the contents of which are incorporated herein by reference.

TECHNICAL FIELD

The present disclosure relates to a heat exchanger and a heat exchanger unit both including flat tubes and fins, a heat exchanger unit, and a refrigeration cycle apparatus, and more particularly to the location of a water conveyance member that causes water staying in the fins to be discharged.

BACKGROUND ART

Of existing heat exchangers, a given heater exchanger is provided with flat tubes that are heat transfer tubes each having a porous elongated section to improve its heat exchange performance. In an example of such a heat exchanger, flat tubes are arranged such that their tube axes extend in a lateral direction, and are also arranged at predetermined intervals in an up/down direction. In such a heat exchanger, fins formed in the shape of a plate are arranged side by side in a direction along the tube axes of the flat tubes, and heat exchange is performed between air that passes between the fins and a fluid that flows in the flat tubes.

Of such heat exchangers, in a known heat exchanger, a spacer having a surface facing a lower end of the heat exchanger is provided (for example, Patent Literature 1). The spacer is provided to guide dew condensation water from the lower end of the heat exchanger to a bottom frame.

CITATION LIST

Patent Literature

Patent Literature 1: Japanese Patent No. 5464207

SUMMARY OF INVENTION

Technical Problem

However, in the heat exchanger disclosed in Patent Literature 1 the spacer is provided over substantially the entire fins in a width direction of the fins in a region located below a heat exchange unit including fins and flat tubes. Therefore, water that flows down through the fins stays between the fins and an upper surface of the spacer. As a result, the water stays at a lower end portion of the heat exchange unit to block up an air passage between the fins, thus reducing the amount of air that passes through the heat exchange unit, and also reducing the heat exchange performance. In addition, in the case where the heat exchanger is used when the temperature of outdoor air is low, the collecting water may be frozen, as a result of which frozen part may expand and the heat exchange unit may be damaged.

The present disclosure is applied to solve the above problems, and relates to heat exchanger, a heat exchanger unit, and a refrigeration cycle apparatus that promote discharge of water from a heat exchange unit to improve a frost resistance and a heat exchange performance.

Solution to Problem

A heat exchanger according to an embodiment of the present disclosure includes: a flat tube; a fin formed in the shape of a plate and having a plate surface that extends in a longitudinal direction of the fin and such that a width direction of the fin is perpendicular to the longitudinal direction, the fin being located such that the longitudinal direction of the fin coincides with an up/down direction and crosses a tube axis of the flat tube; and a first water conveyance member provided below the fin. The fin has a pipe set region located at a pipe-set-side edge that is one end edge of the fin in the width direction, the pipe set region having an insertion portion into which the flat tube is inserted, and a water-conveyance region located at a water-conveyance-side edge that is the other end edge of the fin in the width direction, the water-conveyance region having no insertion portion. The first water conveyance member has a first upper surface that faces a lower end portion of the fin, a first ridge located at one end portion of the first upper surface that is close to the water-conveyance-side edge in a section of the heat exchanger that is perpendicular to the tube axis of the flat tube, and a second ridge located at the other end portion of the first upper surface that is close to the pipe-set-side edge in the section of the heat exchanger that is perpendicular to the tube axis of the flat tube, the second ridge being located below the water-conveyance region of the fin.

A heat exchanger unit according to another embodiment of the present disclosure includes the heat exchanger and a fan that sends air to the heat exchanger. The heat exchanger is provided that the water-conveyance region is located upwind of the pipe-set region.

A refrigeration cycle apparatus according to still another embodiment of the present disclosure is provided with the heat exchanger unit.

Advantageous Effects of Invention

According to the present disclosure, since the second ridge, which is one of the ridges of the first water conveyance member and is located closer to the pipe set region, is provided below the water-conveyance region of the fin, water at the lower end portion of the fin flows downwards from the second ridge of the first water conveyance member and discharge of the water from the heat exchanger is promoted.

DESCRIPTION OF EMBODIMENTS

Embodiments of a heat exchanger, a heat exchanger unit, and a refrigeration cycle apparatus will be described below. The configurations as illustrated in the figures are merely examples, and the configurations of the embodiments of the present disclosure are not limited to the configurations as illustrated in the figures. In each of the figures, components that are the same as or equivalent to those in a previous figure or figures are denoted by the same reference signs. The same is true of the entire text of the specification. Furthermore, the configurations of the components described in the entire text of the present specification are merely examples, and the configurations of the actual components are not limited to those described in the present specification. In particular, it should be noted that each of combinations of the components is not limited to a combination of components according to the same configuration, that is, a component according to an embodiment can be combined with a component according to another embodiment. Moreover, in the case where components that are of the same kind and denoted by reference signs including suffixes do not need to be distinguished from each other, the suffixes may be omitted. In addition, the relationships in size between the components in the figures may differ from the actual ones. It should be noted that the x direction, y direction, and z direction indicated in each of figures are the same directions as the x direction, y direction, and z direction in the other figures, respectively.

Embodiment 1

Figure 1:
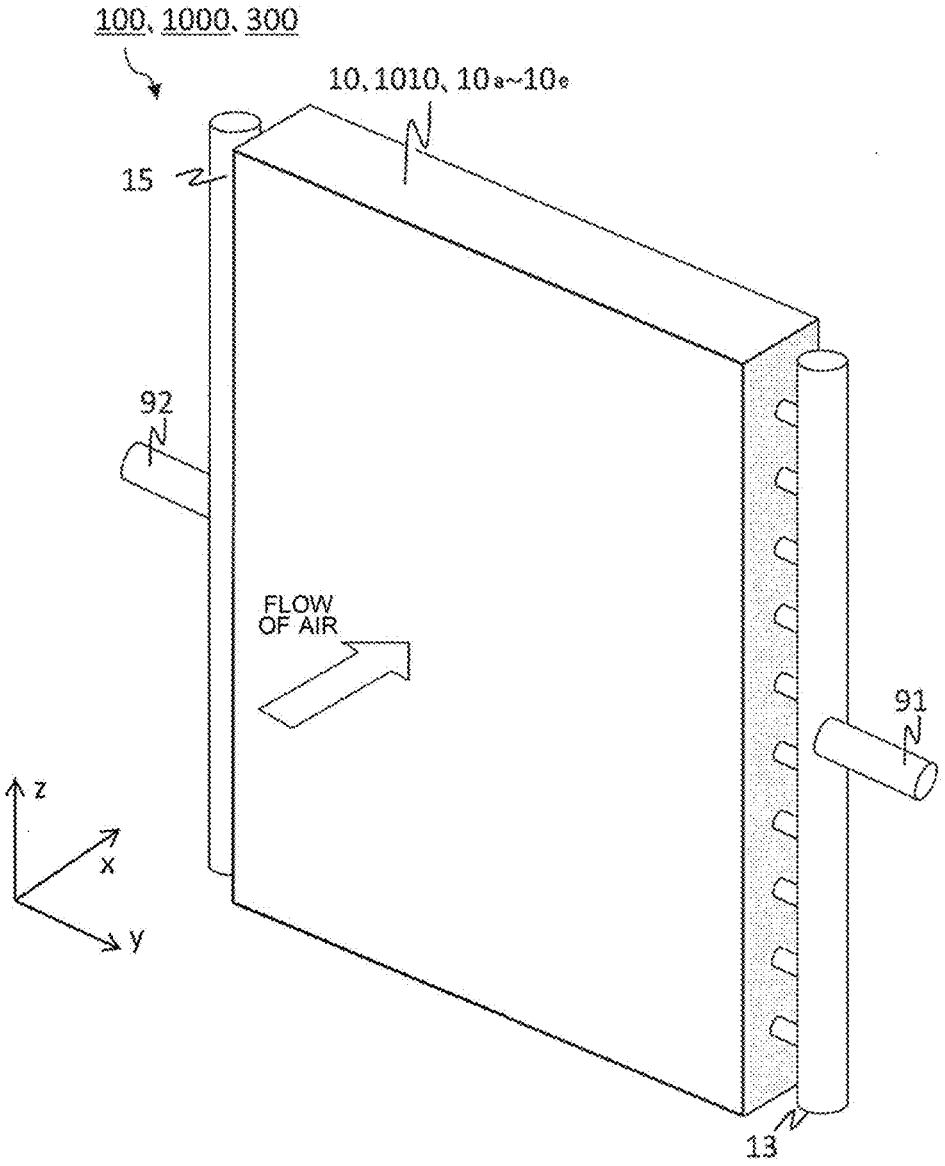
FIG. 1 is a perspective view illustrating a heat exchanger according to Embodiment 1.
Figure 2:
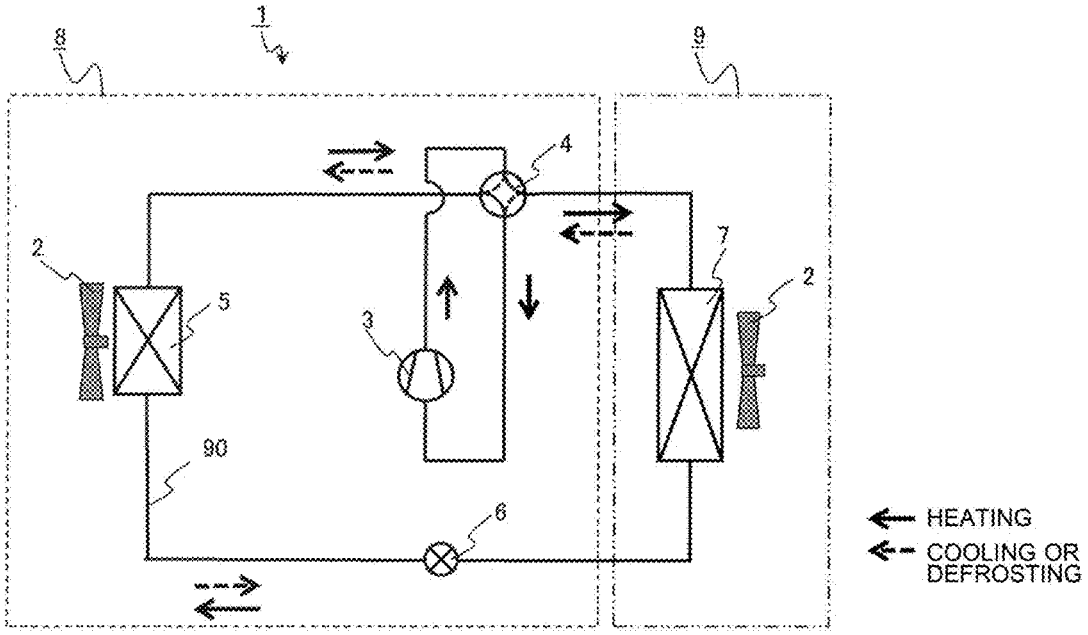
FIG. 2 is an explanatory diagram of a refrigeration cycle apparatus to which the heat exchanger according to Embodiment 1 is applied.

FIG. 1 is a perspective view illustrating a heat exchanger 100 according to Embodiment 1. FIG. 2 is an explanatory diagram of a refrigeration cycle apparatus 1 to which the heat exchanger 100 according to Embodiment 1 is applied. The heat exchanger 100 as illustrated in FIG. 1 is provided in a refrigeration cycle apparatus 1 such as an air-conditioning apparatus or a refrigerator. In Embodiment 1, the air-conditioning apparatus is used as an example of the refrigeration cycle apparatus 1. In the refrigeration cycle apparatus 1, a compressor 3, a four-way valve 4, an outdoor heat exchanger 5, an expansion device 6, and an indoor heat exchanger 7 are connected by refrigerant pipes 90, thereby forming a refrigerant circuit. In the refrigeration cycle apparatus 1, refrigerant flows in the refrigerant pipes 90, and the flow direction of the refrigerant is switched by the four-way valve 4 to switch the operation of the refrigeration cycle apparatus 1 between a heating operation, a refrigerating operation, and a defrosting operation.

The outdoor heat exchanger 5 is provided in the outdoor unit 8 and the indoor heat exchanger 7 is provided in the indoor unit 9, and in regions close to the outdoor heat exchanger 5 and the indoor heat exchanger 7, respective fans 2 are provided. In the outdoor unit 8, outdoor air is sent from the fan 2 to the outdoor heat exchanger 5 and exchanges heat with the refrigerant. In the indoor unit 9, indoor air is sent from the fan 2 to the indoor heat exchanger 7, exchanges heat with the refrigerant, and is thus air-conditioned. Heat exchangers 100 can be used as the outdoor heat exchanger 5 provided in the outdoor unit 8 and the indoor heat exchanger 7 provided in the indoor unit 9 in the refrigeration cycle apparatus 1, and each operate as a condenser or an evaporator. It should be noted that devices in which the heat exchangers 100 are provided, for example, the outdoor unit 8 and the indoor unit 9, will be each referred to as a heat exchanger unit.

The heat exchanger 100 as illustrated in FIG. 1 includes a heat exchange unit 10. In Embodiment 1, air flows into the heat exchanger 100 in the x direction. At both ends of the heat exchange unit 10, respective headers 13 and 15 are provided, and flat tubes 20 are connected between the headers 13 and 15. After flowing from a refrigerant pipe 91 into the header 13, refrigerant passes through the heat exchange unit 10, and then flows from the heat exchange unit 10 into a refrigerant pipe 92 through the header 15. Heat exchange is performed between the refrigerant that flows in each of the flat tubes 20 and air that passes through the heat exchange unit 10.

Figure 3:
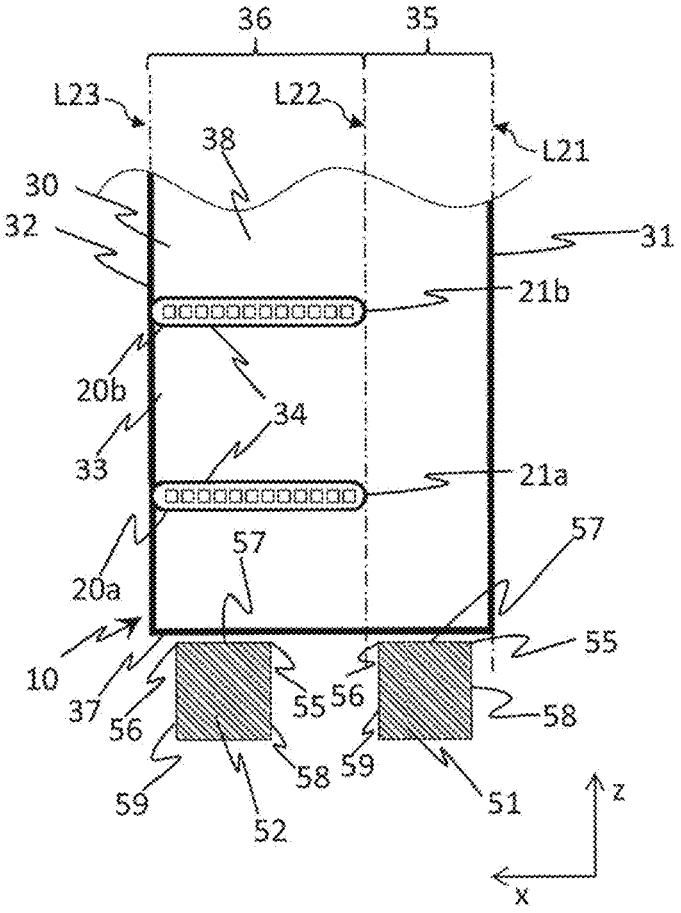
FIG. 3 is an explanatory diagram of a section of the heat exchanger as illustrated in FIG. 1.
Figure 4:
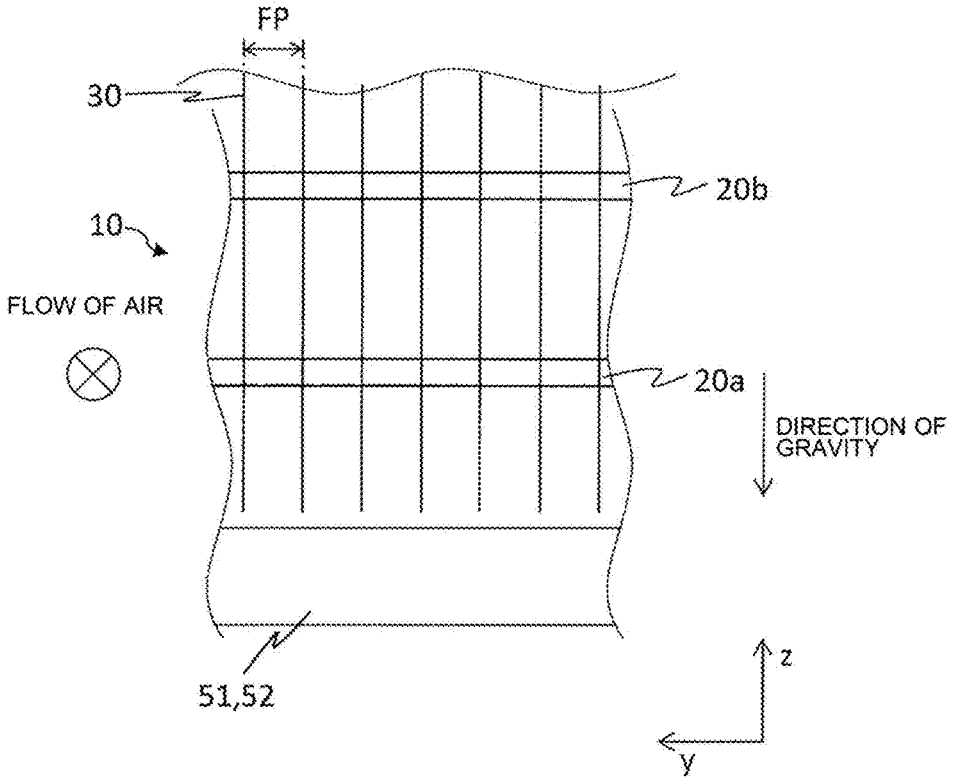
FIG. 4 is a partial front view of the heat exchanger illustrated in FIG. 1.
Figure 5:
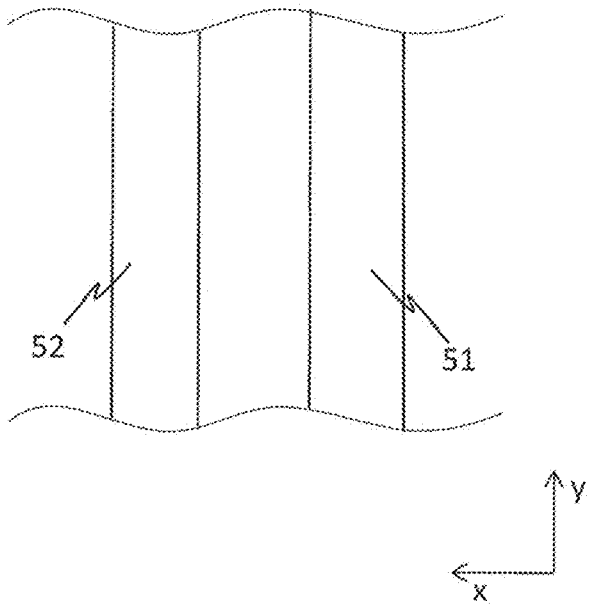
FIG. 5 is a partial top view of a water conveyance member as illustrated in FIG. 3, as viewed from a fin.

FIG. 3 is an explanatory diagram illustrating a section of the heat exchanger 100 as illustrated in FIG. 1. FIG. 4 is a partial front view of the heat exchanger 100 as illustrated in FIG. 1. FIG. 5 is a partial top view of water conveyance members 51 and 52 as illustrated in FIG. 3, as viewed from fins 30. FIG. 3 illustrates a section of the heat exchange unit 10, which is a perpendicular to a y axis, as viewed in they direction. FIG. 4 illustrates the heat exchange unit 10 as viewed in the x direction. FIG. 5 illustrates the water conveyance members 51 and 52 as viewed from a side where the fins 30 are arranged. In the heat exchange unit 10, the flat tubes 20, the tube axes of which extend in in the y direction, are arranged side by side in the z direction. The flat tubes 20 are each formed in an elongated shape having a major axis and a minor axis in a section perpendicular to the tube axis.

The major axes of the flat tubes 20 extend in the x direction. In addition, the fins 30, which are plate-like members, are attached to the flat tubes 20 such that plate surfaces 48 of the fins 30 intersect the tube axis of the flat tube 20. The fins 30 each have a rectangular shape such that the longitudinal direction of each fin 30 extends in a direction in which the flat tubes 20 are arranged side by side. That is, the fins 30 extend such that the longitudinal direction of each fin 30 coincides with the z direction and a width direction of each fin 30 that is perpendicular to the longitudinal direction coincides with the x direction. The fins 30 are provided with insertion portions 24 into which the flat tubes 20 are inserted. In Embodiment 1, a water-conveyance-side edge 31, which is one end edge of each fin 30, is located on an upwind side, and a pipe-set-side edge 32, which is the other end edge of each fin 30, is located on a downwind side. In the pipe-set-side edge 32 of each fin 30, an insertion portion 34 is provided as a notch, and the flat tube 20 is inserted into the insertion portion 34.

The refrigerant flows in each of the flat tubes 20, and heat exchange is performed between air sent to the heat exchanger 100 and the refrigerant in the flat tube 20. The fins 30 are arranged in a direction along the tube axes of the flat tubes 20. Any adjacent two of the fins 30 are arranged apart from each other by a predetermined space FP such that air passes through the space FP. The adjacent fins 30 contact air that passes through the space FP between the fins 30, and transfer heat to the refrigerant to achieve heat exchange.

As illustrated in FIG. 3, the fins 30 are arranged such that the longitudinal direction of the fins 30 are parallel to the direction in which the flat tubes 20 are arranged side by side, That is, the longitudinal direction of the fins 30 is coincident with the z direction. In Embodiment 1, the fins 30 are arranged such that the longitudinal direction of the fins 30 is coincident with the direction of gravitational force. The heat exchange unit 10 includes a first water conveyance member 51 and a second water conveyance member 52 below the fins 30. In the following description, the first water conveyance member 51 and the second water conveyance member 52 may be referred to as water conveyance members 51 and 52.

As illustrated in FIG. 3, the water conveyance members 51 and 52 are located below lower end edges 37 of the fins 30. In Embodiment 1, the water conveyance members 51 and 52 are arranged, with spaces provided between the water conveyance members 51 and 52 and the lower end edges 37. In addition, as illustrated in FIGS. 4 and 5, the water conveyance members 51 and 52 extend such that the longitudinal direction of the water conveyance members 51 and 52 is coincident with the y direction. The water conveyance members 51 and 52 are each formed such that a section of each water conveyance member that is perpendicular to the y-axis is rectangular as illustrated in FIG. 3, and each include an upper surface 57 having a first ridge 55 located at one end portion of the upper surface 57 and a second ridge 56 located at the other end portion of the upper surface 57. Furthermore, the water conveyance members 51 and 52 each include a first side surface 58 extending downwards from the first ridge 55 and a second side surface 59 extending downwards from the second ridge 56. The first side surface 58 and the second side surface 59 are located perpendicular to the upper surface 57. The sectional shapes of the water conveyance members 51 and 52 are not limited to the shapes illustrated in FIG. 3. As long as the upper surface 57 is located perpendicular to the first side surface 58 and the second side surface 59, the water conveyance members 51 and 52 may be, for example, hollow members, or plate members that are each bent to form the upper surface 57, the first side surface 58, and the second side surface 59. The upper surface 57 of the first water conveyance member 51 may be referred to as a first upper surface, and the upper surface 57 of the second water conveyance member 52 may be referred to as a second upper surface.

The first water conveyance member 51 is located below a water-conveyance region 35 of each fin 30 that adjoins the water-conveyance-side edge 31 of the fin 30, The water-conveyance region 35 of the fin 30 is a region located between the water-conveyance-side edge 31 and a straight line L22 as indicated in FIG. 3. The straight line L22 is a straight line that passes through edges of the insertion portions 34 provided in the fin 30, which are close to the water-conveyance-side edge 31. The water-conveyance region 35 is a region in which the flat tubes 20 are not provided. It should be noted that the direction of gravitational force is opposite to the z direction, and the flat tubes 20 obstruct the flow of water such as dew condensation water or frost melt water that flows from upper portion of the fin 30. In Embodiment 1, the first ridge 55 and the second ridge 56 of the first water conveyance member 51 are located below the water-conveyance region 35. That is, the upper surface 57 of the first water conveyance member 51 is located between the straight line 22 and a straight line L21 which is an extension to the water-conveyance-side edge 31.

The second water conveyance member 52 is located below a pipe set region 36 of each fin 30 that adjoins the pipe-set-side edge 32 of the fin 30. The pipe set region 36 of the fin 30 is a region located between the pipe-set-side edge 32 and the straight line L22 indicated in FIG. 3. The pipe set region 36 is a region in which the flat tubes 20 are arranged side by side in the z direction. In Embodiment 1, the first ridge 55 and the second ridge 56 of the second water conveyance member 52 are located below the pipe set region 36. That is, the upper surface 57 of the second water conveyance member 52 is located between the straight line L22 and a straight line L23, which is an extension line to the pipe-set-side edge 32.

Figure 6:
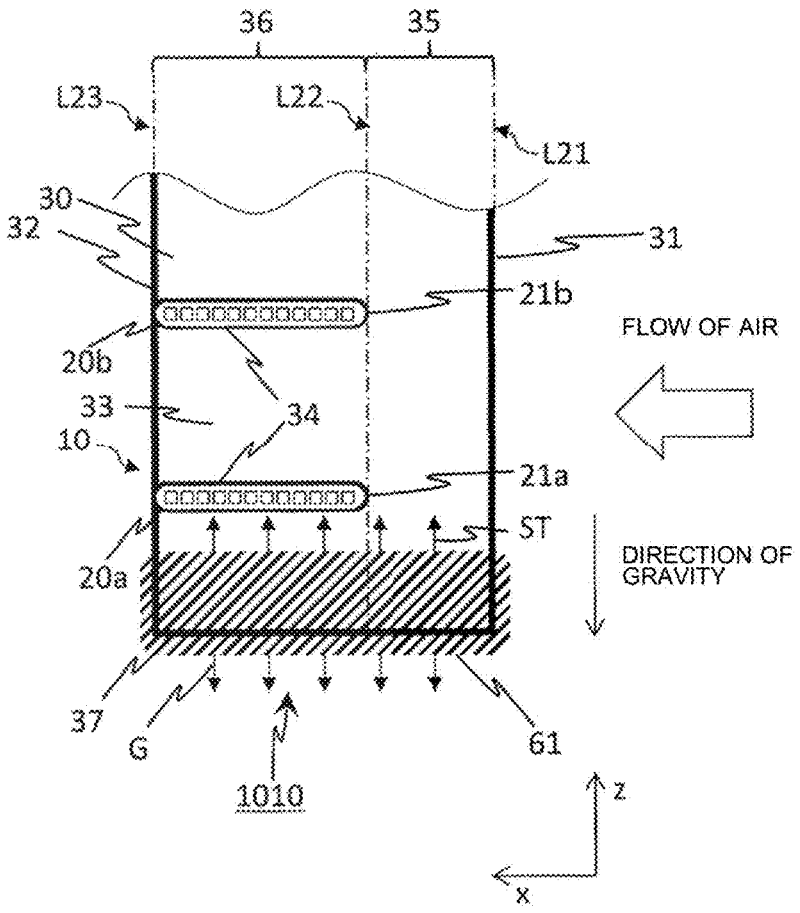
FIG. 6 is an explanatory diagram of a section of a heat exchanger that is a comparative example of the heat exchanger according to Embodiment 1.
Figure 7:
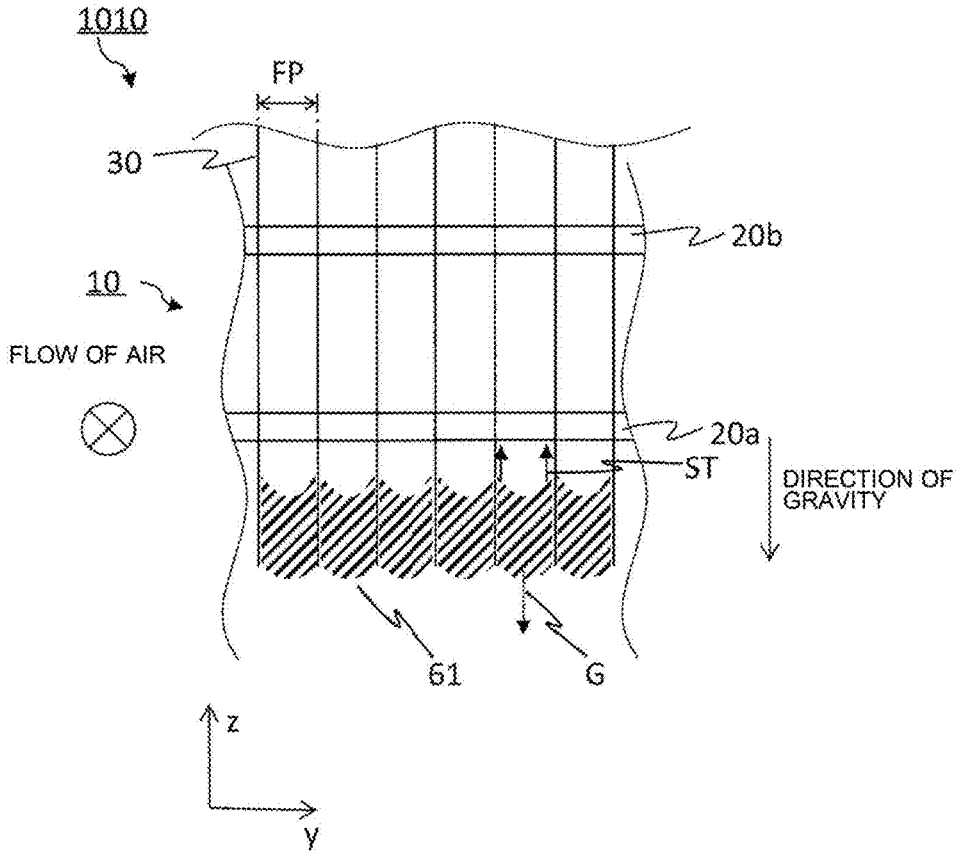
FIG. 7 is a partial front view of the heat exchanger that is a comparative example of the heat exchanger according to Embodiment 1.

FIG. 6 is an explanatory diagram illustrating a section of a heat exchanger 1000 that is a comparative example of the heat exchanger 100 according to Embodiment 1, FIG. 7 is a partial front view of the heat exchanger 1000. Unlike the heat exchange unit 10 according to Embodiment 1, in the comparative example, a heat exchange unit 1010 of the heat exchanger 1000 includes no members corresponding to the water conveyance members 51 and 52. In the heat exchange unit 1010, water that flows downwards from the upper portion and flows through the water-conveyance region 35 collects in the space FP at the lower end portion of the fin 30. FIGS. 6 and 7 schematically illustrates water 61 that collects at the lowermost end portion of the heat exchange unit 1010. When water flows down from a region located above the heat exchange unit 1010, the amount of the collecting water 61 increases, the collecting water 61 expands downwards, and the influence of gravity increases. When gravity G that acts on the collecting water 61 becomes stronger than surface tension ST of the collecting water 61, the water 61 is not affected by the surface tension ST and falls down the lower end edge 37 of the fin 30. Then, the water 61 is received by a drain pan provided below the heat exchange unit 1010.

<Advantages of Heat Exchanger 100 According to Embodiment 1>

In the heat exchange unit 1010 of the heat exchanger 1000 of the comparative example, when the gravity G that is stronger than the surface tension ST acts on the water 61 that collects at the lower end portion, the water 61 flows out of the heat exchange unit 1010. Therefore, a predetermined amount of water stays at the lower end portion of the heat exchange unit 1010 of the comparative example. By contrast, below the heat exchange unit 10, the first water conveyance member 51 and the second water conveyance member 52 are provided. Thus, when gravity acts on the water that collects at the lower end portion of the heat exchange unit 10, and the water expands toward a region located blow the fins 30, the water comes in contact with at least one of the first water conveyance member 51 and the second water conveyance member 52, and a surface tension occurs to act in the opposite direction to the z direction. Therefore, the gravity and the surface tension act on the water collecting at the lower end portion of the heat exchange unit 10, in the opposite direction to the z direction, thereby promoting discharge of the water.

In particular, water that flows down from the upper portion of the heat exchange unit 10 easily concentratedly collects in the water-conveyance region 35 located between the water-conveyance-side edge 31 and the straight line L22. When the temperature of outdoor air is below the freezing point or close to a temperature below the freezing point, frost adheres to the heat exchange unit 10, and the refrigeration cycle apparatus 1 thus performs a frost melting operation. In the frost melting operation, since the supply of air to the heat exchanger 100 is stopped, the water adhering to the heat exchange unit 10 is affected only by gravity, and flows down in the opposite direction to the z direction. Therefore, in the heat exchange unit 10, in the water-conveyance region 35, in the frost melting operation, the amount of water that flows down to the water-conveyance region 35 under the influence of the gravity is relative large, and discharge of the water collecting in a lower part of the water-conveyance region 35 is promoted by the first water conveyance member 51 provided below the water-conveyance region 35.

In addition, when the heat exchanger 100 operates as a common evaporator in the refrigeration cycle apparatus 1, air flows into the heat exchange unit 10. Therefore, the water that flows down to the lower end portion of the heat exchange unit 10 easily flows downwards under the influence of the flow of air. Thus, the water easily collects at the lower end portion of the pipe set region 36 located between the pipe-set-side edge 32 and the straight line L22. In the heat exchange unit 10, since the second water conveyance member 52 is provided below the pipe set region 36, it is possible to promote discharge of the water from the lower end portion of the pipe set region 36 in which the water easily collects when the heat exchange unit 10 operates as the common evaporator.

As described above, in the heat exchanger 100 according to Embodiment 1 the heat exchange unit 10 includes the first water conveyance member 51 and the second water conveyance member 52 below the lower end edges 37 of the fins 30, thereby discharge of water from the heat exchange unit 10 can be promoted. Since discharge of the water from the heat exchange unit 10 is promoted, blockage of the spaces FP between the fins 30 can be reduced and a heat exchange performance is improved. In addition, it is possible to prevent the heat exchange unit 10 from being broken due to freezing of water in the spaces FP between the fins 30 that occurs when the temperature of outside air is low. Furthermore, since the amount of water that is frozen can also be reduced, the amount of heat for melting during a defrosting operation can be reduced, and time required for the defrosting operation can thus be shortened. In Embodiment 1, the z direction coincides with the direction of gravitational force; however, for example, also in the case where the heat exchanger 100 is provided such that the z direction is inclined to the direction of gravitational force, discharge of water can be promoted. However, the water conveyance members 51 and 52 need to be located below the fins 30 in the direction of gravitational force.

<Modifications of Heat Exchange Unit 10 According to Embodiment 1>

Figure 8:
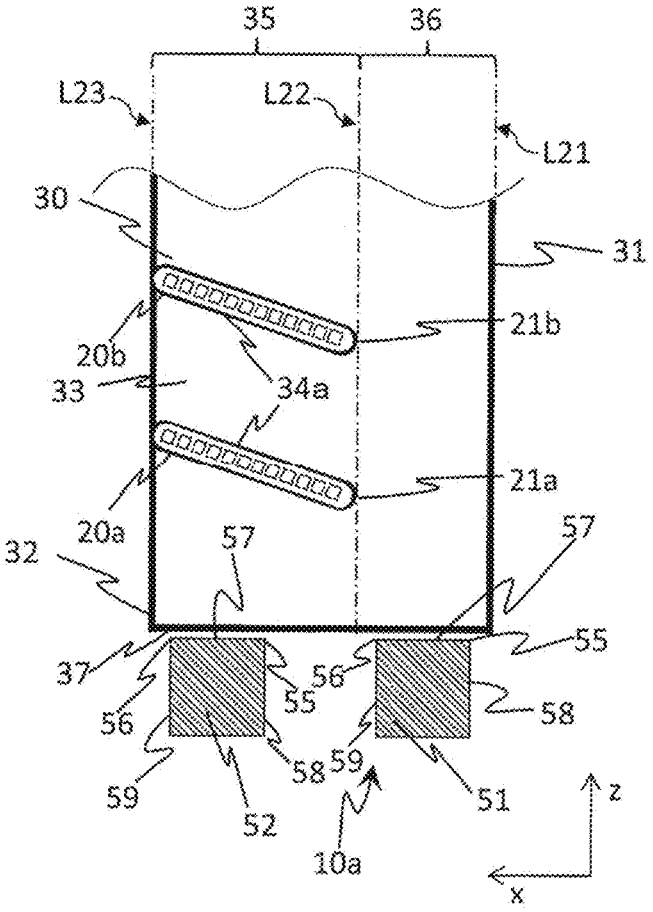
FIG. 8 is an explanatory diagram of a section of a heat exchange unit that is a modification of the heat exchange unit according to Embodiment 1.

FIG. 8 is an explanatory diagram illustrating a section of a heat exchange unit 10*a* that is a modification of the heat exchange unit 10 according to Embodiment 1. FIG. 8 illustrates the same section as FIG. 3. In the heat exchange unit 10*a*, the flat tubes 20 are inclined. In this regard, the heat exchange unit 10*a* is different from the heat exchange unit 10. To be more specific, in a flat tube 20*a* and a flat tube 20*b*, positions of end portions 21*a* and 21*b* located close to the water-conveyance-side edge 31 are lower than those of end portions located close to the pipe-set-side edge 32. That is, the flat tube 20*a* and the flat tube 20*b* are inclined toward the water-conveyance region 35 in the opposite direction to the z direction.

In the heat exchanger 100 according to Embodiment 1, the opposite direction to the z direction coincides with the direction of gravitational force. Therefore, water staying on the flat tubes 20*a* and 20*b* is guided to the water-conveyance region 35 by gravity. As in the heat exchange unit 10, in the heat exchange unit 10*a* also, water flows down from the upper portion of the heat exchange unit 10*a* to the water-conveyance region 35. In addition to the water that flows down from the upper portion, the water on the flat tube 20 is also guided from the water-conveyance region 35 to the lower end portion of the fin 30. In the heat exchange unit 10*a* also, the water conveyance members 51 and 52 are provided below the lower end edge 37 of each fin 30. Since the first water conveyance member 51 is located below the water-conveyance region 35, discharge of water from the lower end portion of the water-conveyance region 35 is promoted. In addition, since the second water conveyance member 52 is also located below the pipe set region 36, discharge of water that collects at the lower end portion of the pipe set region 36 is promoted.

In the heat exchange unit 10*a* of the modification, since the water conveyance members 51 and 52 are arranged in the same manner as the heat exchange unit 10, it is possible to obtain the same advantages as in the heat exchange unit 10. In addition, in the heat exchange unit 10*a*, the flat tubes 20 are inclined. Thus, even when water adhering to an intermediate region 33 between the flat tube 20*a* and the flat tube 20*b* flows down and collects on an upper surface of the flat tube 20*a*, the water is guided to the water-conveyance region 35. Therefore, in the heat exchange unit 10*a*, discharge of the water adhering to the pipe set region 36 is improved than in the heat exchange unit 10.

Figure 9:
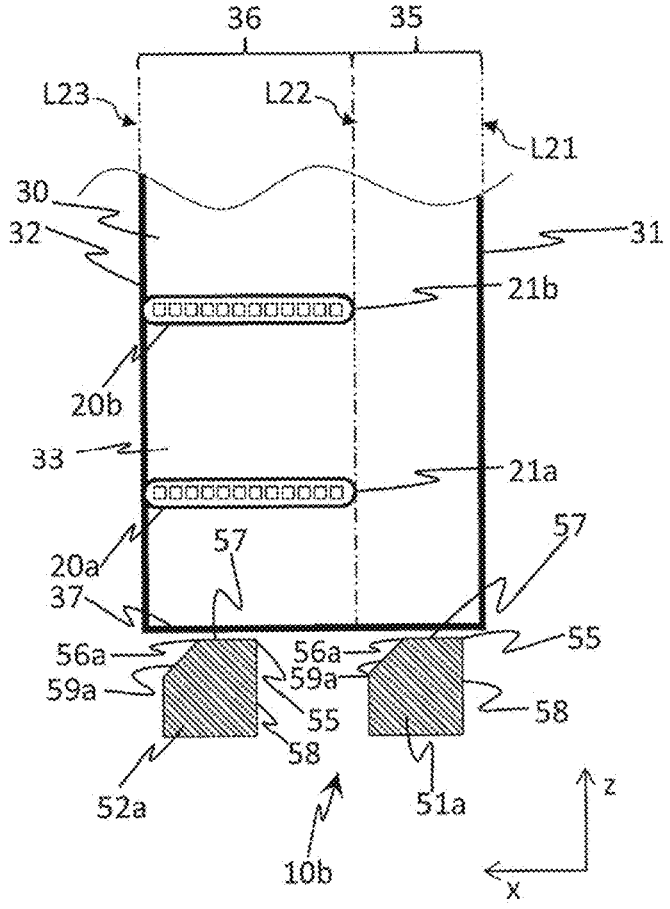
FIG. 9 is an explanatory diagram of a section of a heat exchange unit that is another modification of the heat exchange unit according to Embodiment 1.

FIG. 9 is an explanatory diagram illustrating a section of a heat exchange unit 10*b* that is another modification of the heat exchange unit 10 according to Embodiment 1. FIG. 9 illustrates the same section as in FIG. 3. The heat exchange unit 10*b* is different from the heat exchange unit 10 in shapes of the water conveyance members 51 and 52. To be more specific, the heat exchange unit 10*b* includes a first water conveyance member 51*a* and a second water conveyance member 52*a*. Each of the first water conveyance member 51*a* and the second water conveyance member 52*a* includes a second side surface 59*a* that extends downwards from a second ridge 56*a*, The second side surface 59*a* is formed to obliquely extend, and is inclined from the second ridge 56*a* toward the pipe-set-side edge 32 of each fin 30 in the opposite direction to the z direction.

The first water conveyance member 51*a* is provided below the water-conveyance region 35, and at least the first ridge 55 and the second ridge 56*a* are located between an extension to the water-conveyance-side edge 31 and the straight line L22. In addition, the second water conveyance member 52*a* is provided below the pipe set region 36, and at least the first ridge 55 and the second ridge 56*a* are located between an extension to the pipe-set-side edge 32 and the straight line L22.

Figure 10:
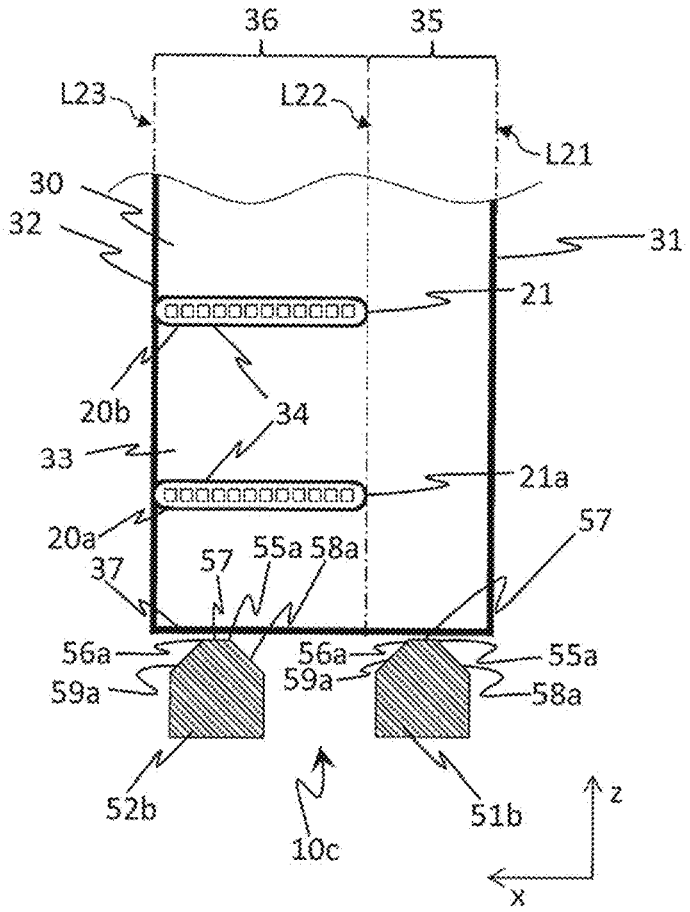
FIG. 10 is an explanatory diagram of a section of a heat exchange unit that is still another modification of the heat exchange unit according to Embodiment 1.

FIG. 10 is an explanatory diagram illustrating a section of a heat exchange unit 10*c* that is still another modification of the heat exchange unit 10 according to Embodiment 1. FIG. 10 illustrates the same section as FIG. 3. The heat exchange unit 10*c* is different from the heat exchange unit 10*b* in shapes of the water conveyance members 51 and 52. To be more specific, the heat exchange unit 10*c* includes a first water conveyance member 51*b* and a second water conveyance member 52*b*. Each of the first water conveyance member 51*b* and the second water conveyance member 52*b* includes a first side surface 58*a* that extends downward from a first ridge 55*a*. The first side surface 58*a* is formed to extend obliquely and is inclined from the first ridge 55*a* toward the water-conveyance-side edges 31 of fins 30 in the opposite direction to the z direction. The second side surface 59*a* is formed in the same manner as in the first water conveyance member 51*a* and the second water conveyance member 52*a* of the heat exchange unit 10*b*.

In each of the first water conveyance members 51*a* and 51*b* and each of the second water conveyance members 52*a* and 52*b*, an inclined surface is formed from at least one of the first ridge 55*a* and the second ridge 56*a*. Therefore, when the water collecting at the lower end edge 37 of the fin 30 comes into contact with the water conveyance members 51*a*, 51*b*, 52*a*, and 52*b*, the water also comes into contact with the first side surface 58*a* or the second side surface 59*a* that is inclined, and the water is easily guided toward the inclined surface by the surface tension. Thus, the water conveyance members 51*a*, 51*b*, 52*a*, and 52*b* improve discharge of the water.

In Embodiment 1, when air flows into the heat exchanger 100 from the water-conveyance-side edge 31, since the second side surface 59*a* is located on the downwind side, the water is guided toward the second side surface 59*a*, which is located on the downwind side, by the flow of the air. Then, the water staying at the lower end edge 37 of the fin 30 is easily discharged from the fin 30 by the flow of the air, gravity, and a surface tension that occurs because of the contact between the water and the second side surface 59*a*. Each of the water conveyance members 51*a* and 52*a* may be formed to have only the second side surface 59*a* as an inclined surface, which is located on the downwind side, as in the heat exchange unit 10*b*. However, in the case where each of the water conveyance members 51*b* and 52*b* is formed to include inclined surfaces that adjoin the first ridge 55*a* and the second ridge 56*a* as in the heat exchange unit 10*c*, discharge of water can be further improved by a surface tension that occurs because of the contact between the water and the first side surface 58*a*.

Figure 11:
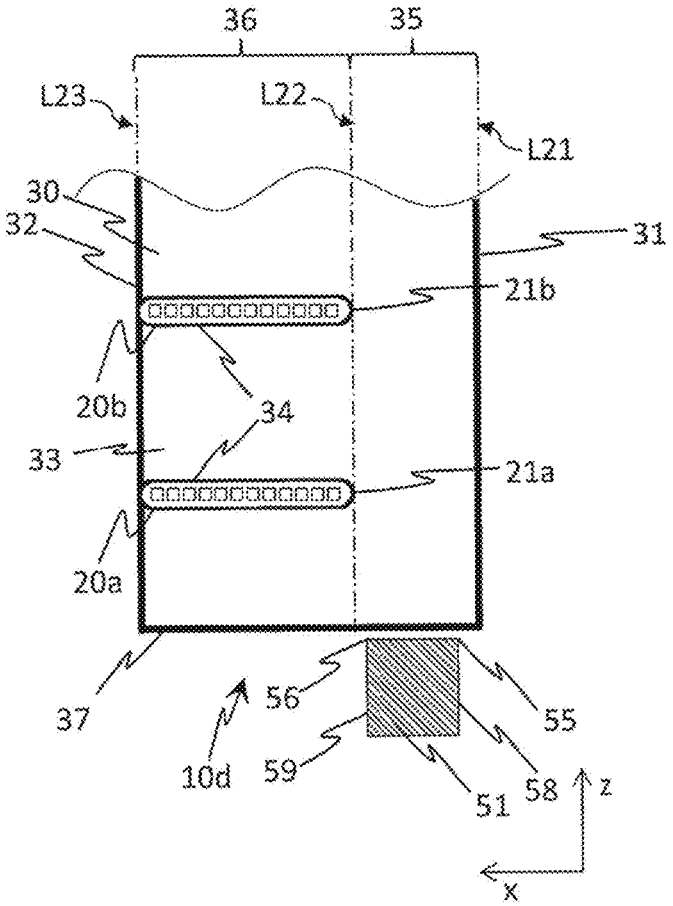
FIG. 11 is an explanatory diagram of a section of a heat exchange unit that is a further modification of the heat exchange unit according to Embodiment 1.

FIG. 11 is an explanatory diagram illustrating a section of a heat exchange unit 10*d* that is a further modification of the heat exchange unit 10 according to Embodiment 1. FIG. 11 illustrates the same section as FIG. 3. In the heat exchanger 100 according to Embodiment 1, the second water conveyance member 52 may be omitted as in the heat exchange unit 10*d*. The first water conveyance member 51 is provided below the water-conveyance region 35 in which water that flows down from the upper portion of the fin 30 most easily collects. Therefore, in the heat exchange unit 10*d*, because of provision of only the first water conveyance member 51, discharge of the water from the lower end portion of the water-conveyance region 35 is promoted, and the heat exchanger 100 can improve the heat exchange performance and prevent occurrence of problems such as damage caused by freezing.

Figure 12:
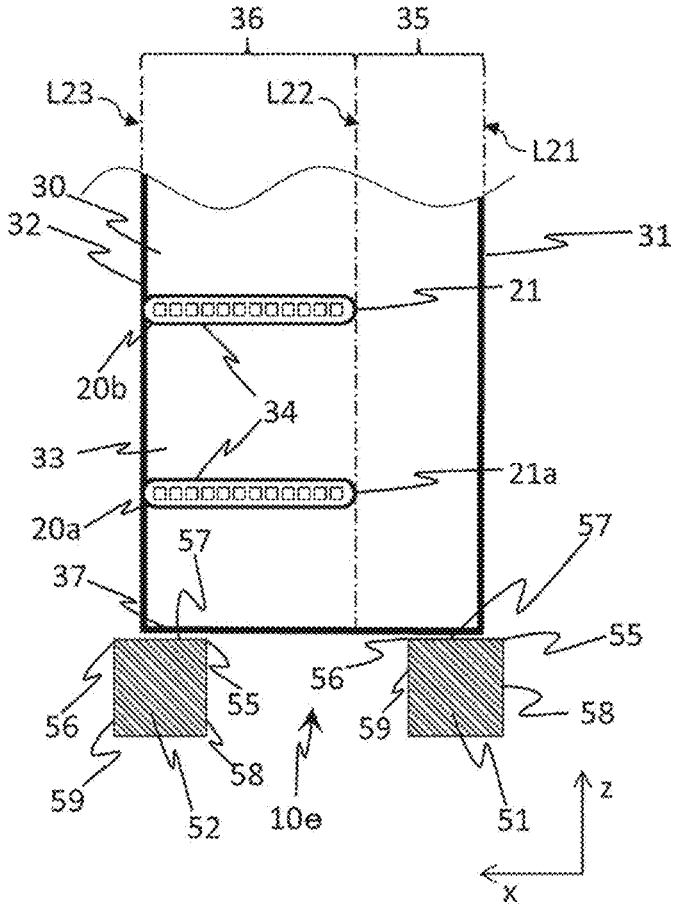
FIG. 12 is an explanatory diagram of a section of a heat exchange unit that is a still further modification of the heat exchange unit according to Embodiment 1.

FIG. 12 is an explanatory diagram illustrating a section of a heat exchange unit 10*e* that is a still further modification of the heat exchange unit 10 according to Embodiment 1. FIG. 12 illustrates the same section as FIG. 3. The heat exchange unit 10*e* is different from the heat exchange unit 10 in arrangement of the first water conveyance member 51 and the second water conveyance member 52. To be more specific, in the heat exchange unit 10*e*, the first water conveyance member 51 is provided such that the first ridge 55 is located outward of the water-conveyance-side edge 31 of each fin 30 in the opposite direction to the x direction. In addition, the second water conveyance member 52 is also provided such that the second ridge 56 is located outward of the pipe-set-side edge 32 of each fin 30 in the x direction. That is, each of the first water conveyance member 51 and the second water conveyance member 52 is provided such that one of the ridges is located outward of each fin 30. In other words, the first water conveyance member 51 has the upper surface 57 provided below the water-conveyance-side edge 31 of each fin 30, and the second water conveyance member 52 has the upper surface 57 provided below the pipe-set-side edge 32 of each fin 30.

In Embodiment 1, since air flows into the heat exchange unit 10*e* in the x direction, dew condensation easily occurs on the water-conveyance-side edge 31. Therefore, in the heat exchange unit 10*e*, a large amount of water flows from the upper portion along the water-conveyance-side edge 31. In this case, since the upper surface 57 of the first water conveyance member 51 is located below the water-conveyance-side edge 31 of each fin 30, the water that flows down along the water-conveyance-side edge 31, on which dew condensation easily occurs, reaches the lower end edge 37 of the fin 30 and comes in contact with the upper surface 57 of the first water conveyance member 51. When coming into contact with the upper surface 57 of the first water conveyance member 51 discharge of the water that has flowed along the water-conveyance-side edge 31 is promoted.

Furthermore, in the pipe set region 36 of the heat exchange unit 10*d*, since the plurality of flat tubes 20 are provided, water does not easily flow down from the upper portion of the fin 30. However, when the heat exchanger 100 operates as an evaporator in Embodiment 1, air flows in the x direction. Therefore, water adhering to the intermediate region 33 flows toward the pipe-set-side edge 32 because of the flow of the air. Therefore, in the pipe-set-side edge 32, the water that has flowed toward the pipe-set-side edge 32 because of the flow of the air flows down to the pipe-side edge 32 from above. At this time, in the case where the upper surface 57 of the second water conveyance member 52 is located below the pipe-set-side edge 32, water that flows down along the pipe-set-side edge 32 reaches the lower end edge 37 of the fin 30 and comes into contact with the upper surface 57 of the second water conveyance member 52. The water that has flowed along the pipe-set-side edge 32 comes into contact with the upper surface 57 of the second water conveyance member 52, and discharge of the water is thus promoted.

As described above, in the heat exchanger 100 according to Embodiment 1, also in the case where at least one ridge of each of the water conveyance members 51 and 52 is located below the lower end edge 37 of the fin 30 as in the heat exchange units 10 and 10*a* to 10*e*, discharge of water can be improved.

Embodiment 2

In a heat exchanger 200 according to Embodiment 2, a plurality of heat exchange units 10 are provided. In this regard, the heat exchanger 200 according to Embodiment 2 is different from the heat exchanger 100 according to Embodiment 1. The heat exchanger 200 according to Embodiment 2 will be described by referring mainly to the differences between the heat exchanger 200 and the heat exchanger 100 according to Embodiment 1. Regarding the heat exchanger 200 according to Embodiment 2, components as illustrated in the figures that have the same functions as those in Embodiment 1 will be denoted by the same reference signs.

Figure 13:
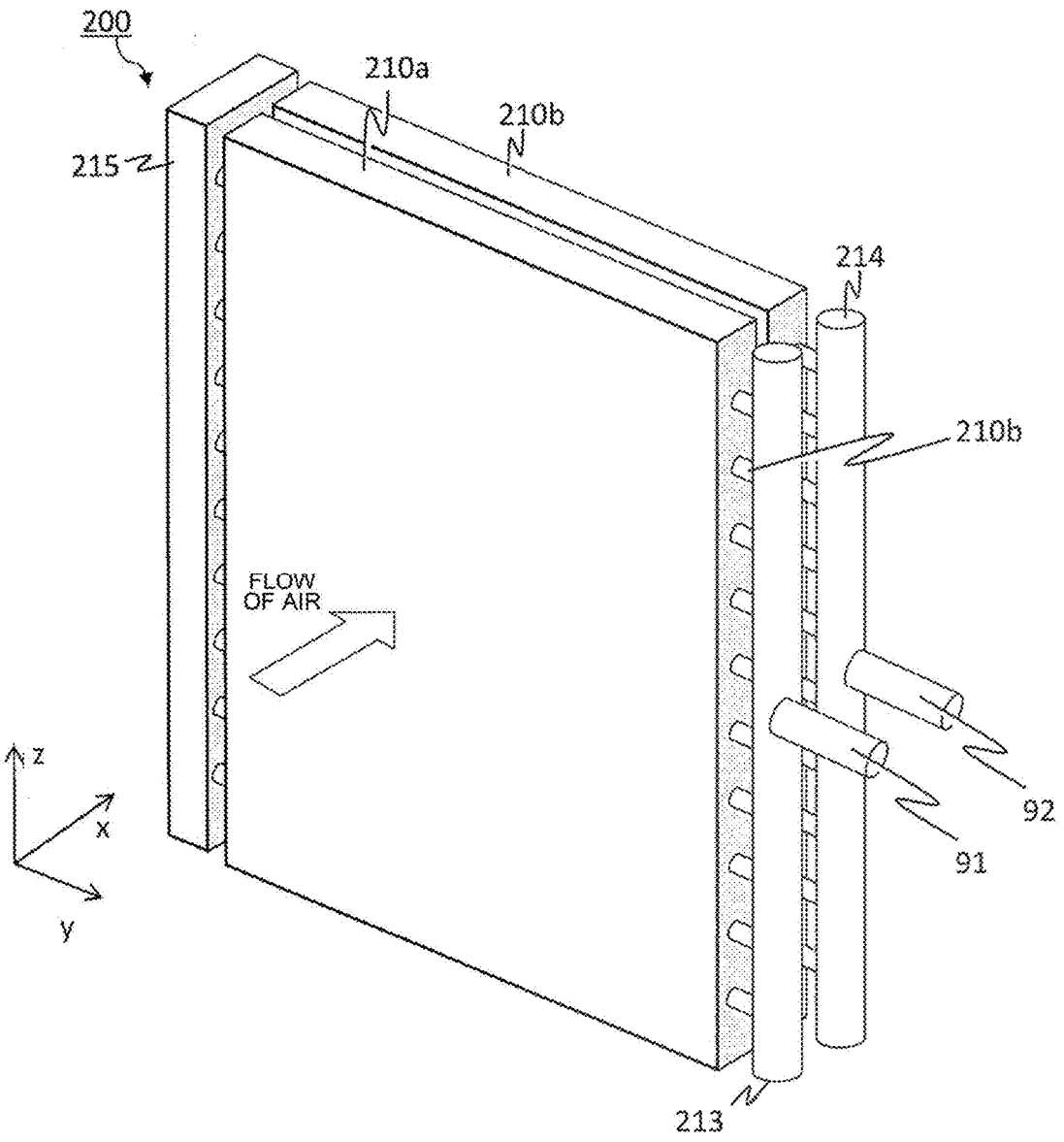
FIG. 13 is a perspective view illustrating a heat exchanger according to Embodiment 2.

FIG. 13 is a perspective view illustrating the heat exchanger 200 according to Embodiment 2. The heat exchanger 200 as illustrated in FIG. 13 includes two heat exchange units 210*a* and 210*b*. The heat exchange units 210*a* and 210*b* are arranged in the x direction as illustrated in FIG. 1. The x direction is perpendicular to a direction in which flat tubes 20 of each of the heat exchange units 210*a* and 210*b* are arranged side by side and pipe axes of the flat tubes 20. In Embodiment 2, air flows into the heat exchanger 200 in an x direction. That is, the heat exchange units 210*a* and 210*b* are arranged in a direction in which air flows in the heat exchanger 100, the first heat exchange unit 210*a* is located on the upwind side, and the second heat exchange unit 210*b* is located on the downwind side. At both ends of the first heat exchange unit 210*a*, headers 213 and 215 are provided; and flat tubes 20 are connected between the headers 213 and 215. At both ends of the heat exchange unit 210*b*, headers 214 and 215 are provided; and flat tubes 20 are connected between the headers 214 and 215. Refrigerant that flows from a refrigerant pipe 91 into the header 213 passes through the first heat exchange unit 210*a*; flows into the heat exchange unit 210*b* through the header 215, and flows out from the header 214 into a refrigerant pipe 92. It should be noted that the first heat exchange unit 210*a* and the second heat exchange unit 210*b* may have the same structure or different structures.

Figure 14:
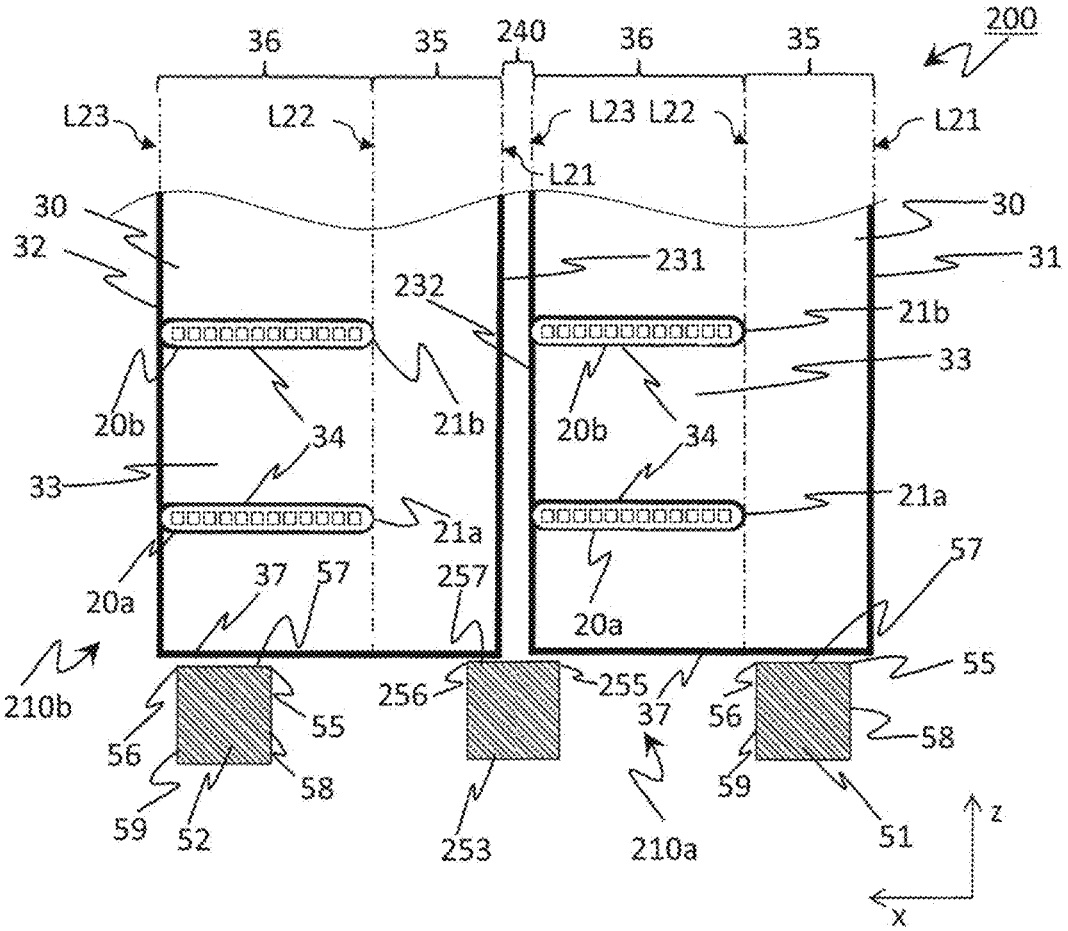
FIG. 14 is an explanatory diagram of a section of the heat exchanger as illustrated in FIG. 13.

FIG. 14 is an explanatory diagram illustrating a section of the heat exchanger 200 as illustrated in FIG. 13. FIG. 14 illustrates a section of the heat exchange unit 210 as illustrated in FIG. 13, which is a perpendicular to the y-axis, as viewed in they direction. The first heat exchange unit 210*a* and the second heat exchange unit 210*b* have the same structure as the heat exchange unit 10 according to Embodiment 1 except for the arrangement of the water conveyance members 51; 52, and 253.

The first heat exchange unit 210*a* is provided such that a pipe-set-side edge 232 faces the second heat exchange unit 210*b*. The second heat exchange unit 210*b* is provided such that a water-conveyance-side edge 231 faces the first heat exchange unit 210*a*. The pipe-set-side edge 232 of the first heat exchange unit 210*a* and the water-conveyance-side edge 231 of the second heat exchange unit 210*b* are located to face each other, with a predetermined space 240 provided between the pipe-set-side edge 232 and the water-conveyance-side edge 231.

The first water conveyance member 51 is provided below the water-conveyance region 35 of the first heat exchange unit 210*a*. The second water conveyance member 52 is provided below the pipe set region 36 of the second heat exchange unit 210*b*. The first water conveyance member 51 and the second water conveyance member 52 may each have at least one of the first side surface 58*a* and the second side surface 59*a* that are inclined surfaces as in the heat exchange units 10*b* and 10*c* of Embodiment 1. In this case, it is possible to obtain the same advantages in the heat exchange units 10*b* and 10*c*. As in the heat exchange unit 10*e* of Embodiment 1, the first water conveyance member 51 and the second water conveyance member 52 may be provided such that the first ridge 55 of the first water conveyance member 51 is located outward of a water-conveyance-side edge 31 of each fin 30 in the first heat exchange unit 210*a* in the opposite direction to the x direction, and a second ridge 56 of the second water conveyance member 52 is located outward of a pipe-set-side edge 32 of each fin 30 in the second heat exchange unit 210*b* in the x direction. By virtue of the above configuration, the first heat exchange unit 210*a* and the second heat exchange unit 210*b* can also obtain the same advantages as the heat exchange unit 10*e* of Embodiment 1.

The third water conveyance member 253 is provided below a space 240 between the first heat exchange unit 210*a* and the second heat exchange unit 210*b*. A first ridge 255 of the third water conveyance member 253 is located below the pipe set region 36 of the first heat exchange unit 210*a*. The second ridge 256 of the third water conveyance member 253 is located below the water-conveyance region 35 of the second heat exchange unit 210*b*. In other words, an upper surface 257 of the third water conveyance member 253 is located below the pipe-set-side edge 232 of the first heat exchange unit 210*a* and the water-conveyance-side edge 231 of the second heat exchange unit 210*b*.

In Embodiment 2, air flows into the first heat exchange unit 210*a* and the second heat exchange unit 210*b* in the x direction. In addition, the heat exchanger 200 is provided such that the opposite direction to the z direction coincides with the direction of gravitational force. Since air flows into the heat exchanger 200 in the x direction, water adhering to the intermediate region 33 of the first heat exchange unit 210*a* flows toward the pipe-set-side edge 232. The water that has reached the pipe-set-side edge 232 flows downwards along the pipe-set-side edge 232 because of gravity, or comes into contact with the water-conveyance-side edge 31 of the second heat exchange unit 210*b* and flows downwards through the space 240.

The space 240 has the same size as the space FP between the fins 30. Thus, water that exists in the space 240 stays at the lower end portion of the fin 30 because of surface tension ST. However, since the upper surface 257 of the third water conveyance member 253 is located below the space 240, water staying at lower end part of the space 240 comes into contact with the upper surface 257 of the third water conveyance member 253, and is thus guided in the opposite direction to the z direction, whereby discharge of the water from the fin 30 is promoted. It should be noted that the upper surface 257 of the third water conveyance member 253 may be referred to as a third upper surface.

Since the first ridge 255 of the third water conveyance member 253 is located below the pipe set region 36 in the first heat exchange unit 210*a*, water that has flowed from the lower end portion of the first heat exchange unit 210*a* comes into contact with the third water conveyance member 253 because of the flow of air, thereby promoting discharge of the water. In addition, since the second ridge 256 of the third water conveyance member 253 is located below the water-conveyance region 35 in the second heat exchange unit 210*b*, water that has flowed from the upper portion of the second heat exchange unit 210*b* to the lower end portion through the water-conveyance region 35 comes into contact with the third water conveyance member 253, thereby promoting discharge of the water. In the case where two heat exchange units 210*a* and 210*b* are arranged in the flow direction of air as in the heat exchanger 200 of Embodiment 2, at part of each fin 30 that is located on the upwind side, condensation easily occurs and water easily adheres. As illustrated in FIG. 14, the third water conveyance member 253 is provided such that the center of the third water conveyance member 253 coincides with the center of the space 240, but can be appropriately shifted depending on the balance between the amounts of dew condensation at the first heat exchange unit 210*a* and the second heat exchange unit 210*b*.

The second water conveyance member 52 of the second heat exchange unit 210*b* may not be omitted. In addition, as a modification of the heat exchanger 200 according to Embodiment 2, at least one of the first heat exchange unit 210*a* and the second heat exchange unit 210*b* may be replaced by any one of the heat exchange units 10, 10*a*, 10*b*, 10*c*, and 10*e* according to Embodiment 1. In any case, as long as at least the water conveyance member is provided below the space 240, it is possible to promote discharge of water from the space 240.

Figure 15:
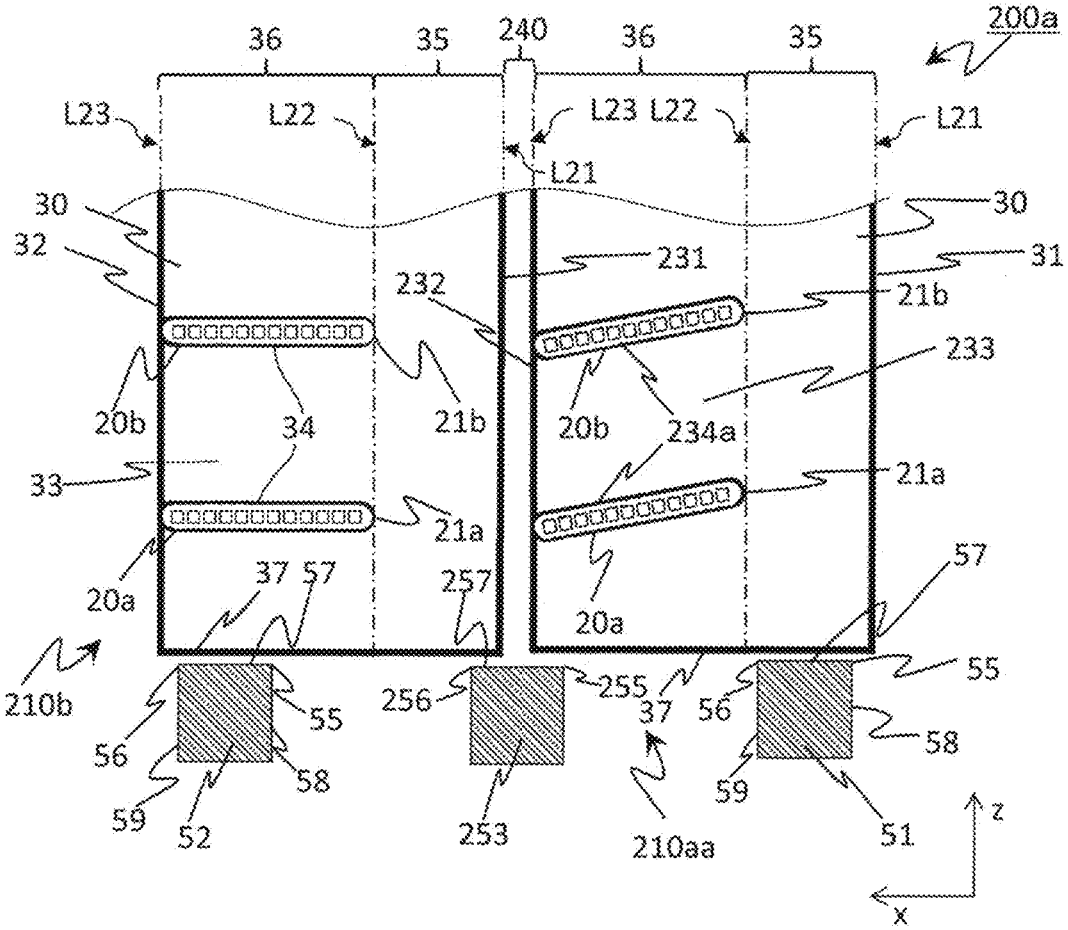
FIG. 15 is an explanatory diagram of a section of a heat exchanger that is a modification of the heat exchanger according to Embodiment 2.

FIG. 15 is an explanatory diagram illustrating a section of a heat exchanger 200*a* that is a modification of the heat exchanger 200 according to Embodiment 2. The heat exchanger 200*a* is different from the heat exchanger 200 in configuration of the first heat exchange unit 210*a*. In a first heat exchange unit 210*aa* of the heat exchanger 200*a*, the flat tubes 20 are inclined toward the pipe-set-side edge 232 in the direction of gravitational force. In the case where water adheres to an intermediate regions 233*a* between insertion portions 234*a* into which flat tubes 20 are inserted, the water easily flows down and easily flows from the upper surfaces of the flat tubes 20*a* toward the pipe-set-side edge 232. Therefore, also in the pipe set region 36 of the first heat exchange unit 210*a* where dew condensation easily occurs compared with the second heat exchange unit 210*b*, water is easily discharged. Furthermore, since the water that has flowed from the pipe set region 36 flows along the space 240, and discharge of the water from the lower end portion is promoted by the third water conveyance member 253, discharge of the water is improved as a whole in the heat exchanger 200*a*.

Figure 16:
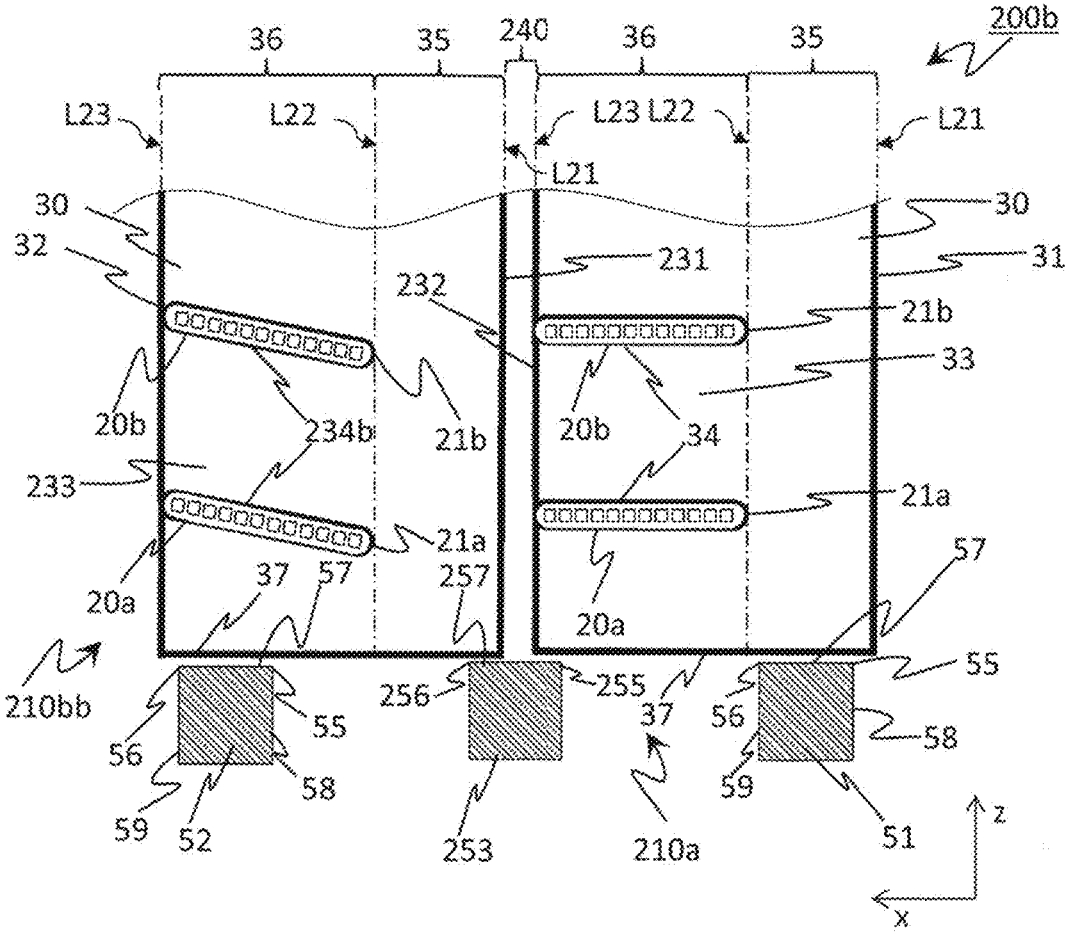
FIG. 16 is an explanatory diagram of a section a heat exchanger that is another modification of the heat exchanger according to Embodiment 2.

In each of the heat exchangers 200 and 200*a* according to Embodiment 2 the flow direction of air is not limited to the x direction; that is, air may be made to flow in the opposite direction to the x direction. When air flows into the heat exchanger 200 or 200*a* in the opposite direction to the x direction, the distribution of water that adheres to the fin 30 due to dew condensation changes. However, since the heat exchange unit 210*a*, 210*aa*, or 210*b* includes the water conveyance members that are arranged below the fin 30, when water flows downwards in the fin 30 and reaches the lower end edge 37, the water comes in contact with the water conveyance members 51, 51*a*, 52, 52*a*, and 253, thereby promoting discharge of the water. In addition, in the case where air is made to flow in the opposite direction to the x direction, the heat exchange unit 10*a* according to Embodiment 1 in which the flat tubes 20 are inclined toward the water-conveyance region 35 in the direction of gravitational force may be used instead of the heat exchange unit 210*b*. Since the flat tubes 20 are inclined toward the downwind side in the direction of gravitational force, the water in the intermediate region 233*a* is easily discharged, and discharge of water is improved as a whole in the heat exchanger 200 or 200*a*, FIG. 16 is an explanatory diagram illustrating a section of a heat exchanger 200*b* that is another modification of the heat exchanger 200 according to Embodiment 2. The heat exchanger 200*b* includes a second exchange unit that is different in configuration from the second exchange unit 210*b* of the heat exchanger 200. To be more specific, in a second heat exchange unit 210*bb* of the heat exchanger 200*b*, the flat tubes 20 are inclined toward the water-conveyance-side edge 231 in the direction of gravitational force. Water adhering in an intermediate region 233*b* between insertion portions 234*b* into which the flat tubes 20 are inserted easily flows from the upper surfaces of the flat tubes 20*a* to the water-conveyance region 35. Therefore, also in the pipe set region 36 of the second heat exchange unit 210*bb*, water is easily discharged.

In the heat exchanger 200*b* according to Embodiment 2, the flow direction of air is not limited to the x direction; that is, air is made to flow in the opposite direction to the x direction. When air flows into the heat exchanger 200*b* in the opposite direction to the x direction, the distribution of water adhering to the fin 30 due to the dew condensation changes, and dew condensation easily occurs in the pipe set region 36 of the second heat exchange unit 210*bb* located on the upwind side. In this case, in the second heat exchange unit 210*bb*, since the flat tubes 20 are inclined toward the water-conveyance region 35, water adhering in the intermediate region 233*b* easily flows to the water-conveyance region 35. In addition, in the case where air flows in the opposite direction to the x direction, the water adhering in the intermediate region 233*b* is guided to the water-conveyance region 35 by the flow of air, thereby promoting discharge of the water.

Figure 17:
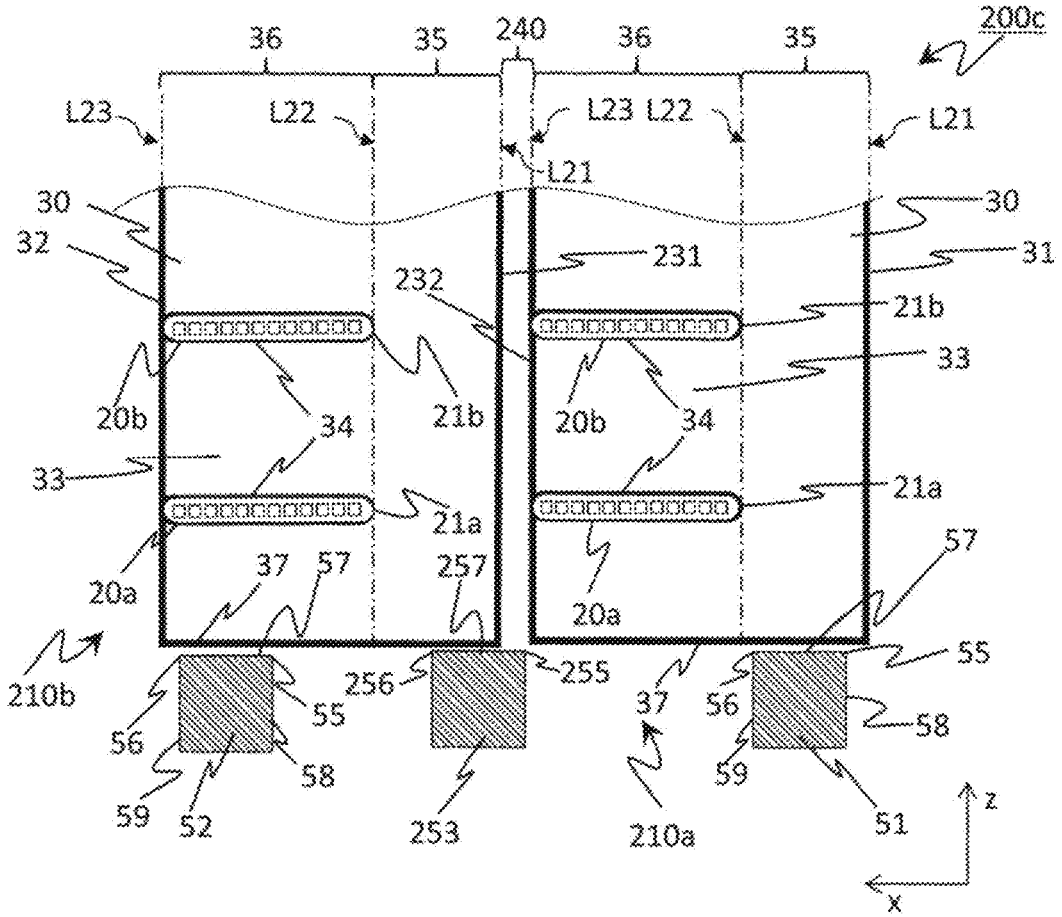
FIG. 17 is an explanatory diagram of a section structure of a heat exchanger that is still another modification of the heat exchanger according to Embodiment 2.

FIG. 17 is an explanatory diagram illustrating a section of a heat exchanger 200*c* that is still another modification of the heat exchanger 200 according to Embodiment 2. The heat exchanger 200*c* is different from the heat exchanger 200 in the position of the third water conveyance member 253. In the heat exchanger 200*c*, the first ridge 255 of the third water conveyance member 253 is located below the space 240 between the first heat exchange unit 210*a* and the second heat exchange unit 210*b*. Because of the above configuration, since water that flows along the space 240 and reaches the upper surface 257 of the third water conveyance member 253 is discharged downwards from the first ridge 255, discharge of the water that flows along the space 240 is promoted. In addition, since the third water conveyance member 253 is located close to the water-conveyance region 35 of the second heat exchange unit 210*b*, when air flows into the heat exchanger 200*c* in the x direction, discharge of water that flows along the water-conveyance region 35 in the second heat exchange unit 210*b*, which is a region where dew condensation easily occurs, is promoted. The location of the third water conveyance member 253 of the heat exchanger 200*c* can also be applied to the heat exchanger 200*a* or 200*b*.

Embodiment 3

In a heat exchanger 300 according to Embodiment 3, the water conveyance members 51 and 52 of the heat exchange unit 10 are connected to each other by a fourth water conveyance member 54. In this regard, the heat exchanger 300 according to Embodiment 3 is different from the heat exchanger 100 according to Embodiment 1. The heat exchanger 300 according to Embodiment 3 will be described by referring manly to the differences between Embodiments 1 and 3. Regarding the heat exchanger 100 according to Embodiment 3, components as illustrated in the figures that have having the same functions as those in Embodiment 1 will be denoted by the same reference signs.

Figure 18:
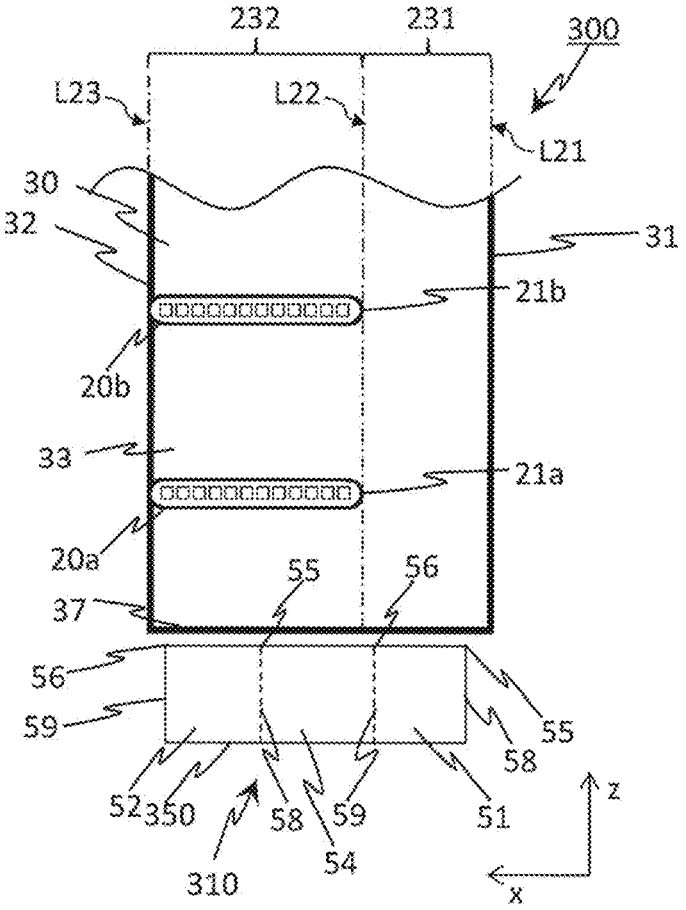
FIG. 18 is an explanatory diagram of a section of a heat exchanger according to Embodiment 3.
Figure 19:
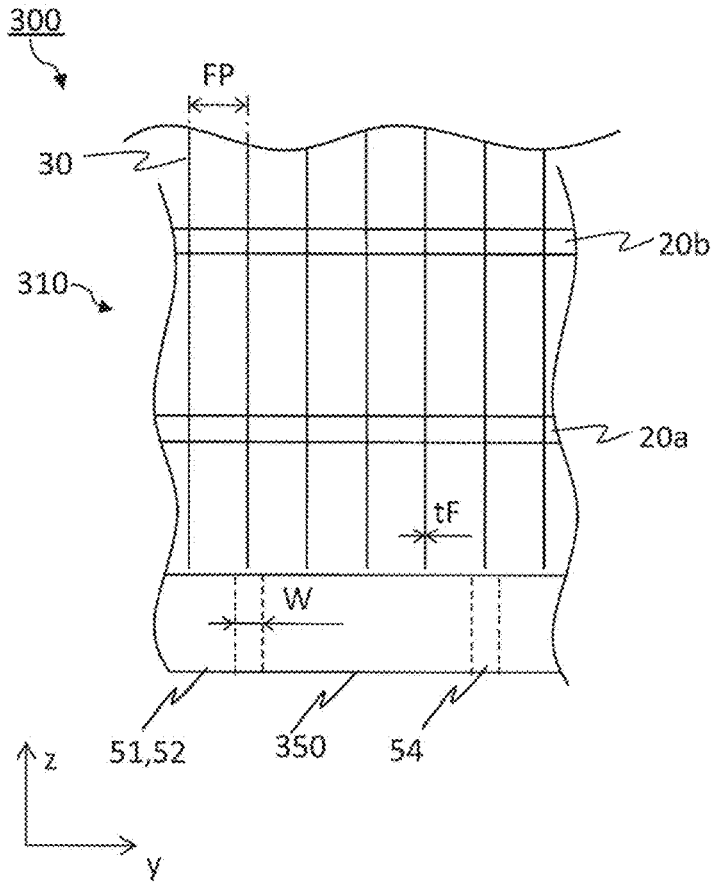
FIG. 19 is a partial front view of the heat exchanger as illustrated in FIG. 18.
Figure 20:
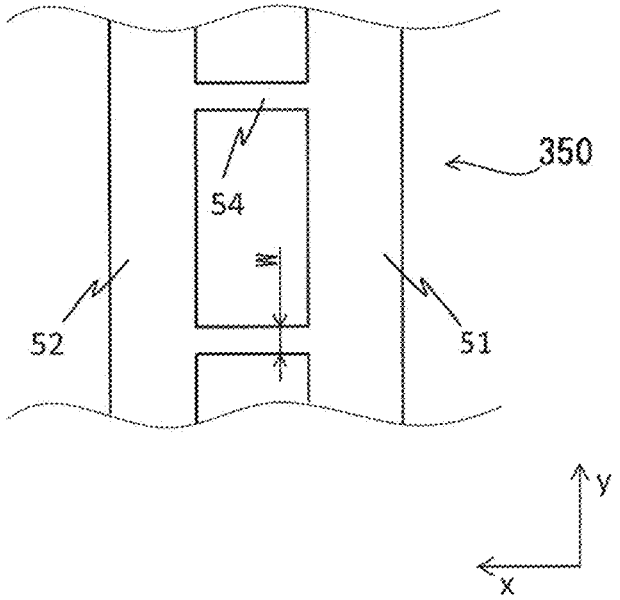
FIG. 20 is a partial top view of water conveyance members as illustrated in FIG. 18, as viewed from a fin.

FIG. 18 is an explanatory diagram illustrating a section of the heat exchanger 300 according to Embodiment 3. FIG. 19 is a partial front view of the heat exchanger 300 as illustrated in FIG. 18. FIG. 20 is a partial top view illustrating water conveyance members 51, 52, and 54 as illustrated in FIG. 18, as viewed from a fin 30. In a heat exchange unit 310 of the heat exchanger 300, the fourth water conveyance members 54 are added to connect the first water conveyance member 51 and the second water conveyance member 52. In this regard, the heat exchange unit 310 of the heat exchanger 300 is different from the heat exchange unit 10 of the heat exchanger 100 according to Embodiment 1. It should be noted that FIG. 18 illustrates a section of a portion where the fourth water conveyance members 54 of the heat exchange unit 310 are provided.

The heat exchange unit 310 includes the first water conveyance member 51 and the second water conveyance member 52, and further includes the fourth water conveyance members 54 that connect the first water conveyance member 51 and the second water conveyance member 52. The fourth water conveyance members 54 are spaced from each other in the y direction, and extend in the x direction to be connected to the first water conveyance member 51 and the second water conveyance member 52.

As illustrated in FIG. 20, to a water-conveyance structure 350, the first water conveyance member 51, the second water conveyance member 52, and the fourth water conveyance member 54 are connected; and the water-conveyance structure 350 is formed in the shape of a lattice as viewed from the fin 30. The fourth water conveyance members 54 each have a width W that is greater than a thickness tF of each of the fins 30 and smaller than the space FP between the adjacent ones of the fins 30. With such a configuration, each of the fourth water conveyance members 54 does not block up the space FP between the fins 30, and does not obstruct discharge of water from the lower end portions of the fin 30.

Since the water-conveyance structure 350 is formed in such a manner as to connect all the first water conveyance member 51, the second water conveyance member 52, and the fourth water conveyance member 54, the water-conveyance structure can be easily set below the fins 30. In addition, since the water-conveyance structure 350 does not block up the spaces FP between the fins 30, the fourth water conveyance members 54 can also promote discharge of water from the lower end portions of the fins 30. Furthermore, the fins 30 are provided in contact with the water-conveyance structure 350, and the water-conveyance structure 350 can support an upper structure such as the fins 30 and the flat tubes 20. It should be noted that the first water conveyance member 51 and the second water conveyance member 52 of the water-conveyance structure 350 may be formed to have the same shapes as those of the first water conveyance members 51*a* and 51*b* and the second water conveyance members 52*a* and 52*b* according to Embodiment 1. In addition, the first water conveyance member 51 and the second water conveyance member 52 of the water-conveyance structure 350 may be arranged in the same manner as in Embodiments 1 and 2.

REFERENCE SIGNS LIST

1 refrigeration cycle apparatus 2 fan 3 compressor 4 four-way valve 5 outdoor heat exchanger 6 expansion device 7 indoor heat exchanger 8 outdoor unit 9 indoor unit 10 heat exchange unit 10*a* heat exchange unit 10*b* heat exchange unit 10*c* heat exchange unit 10*d* heat exchange unit 10*e* heat exchange unit 13 header 15 header 20 flat tube 20*a* flat tube 20*b* flat tube 21*a* end portion

21*b* end portion 24 insertion portion 30 fin 31 water-conveyance-side edge 32 pipe-set-side edge 33 intermediate region

34 insertion portion 35 water-conveyance region 36 pipe set region 37 lower end edge 48 plate surface 51 (first) water conveyance member 51*a* (first) water conveyance member 51*b* (first) water conveyance member 52 (second) water conveyance member 52*a* (second) water conveyance member 52*b* (second) water conveyance member 54 (fourth) water conveyance member 55 first ridge 55*a* first ridge 56 second ridge 56*a* second ridge 57 upper surface 58 first side surface 58*a* first side surface 59 second side surface 59*a* second side surface 61 collecting water 90 refrigerant pipe 91 refrigerant pipe 92 refrigerant pipe 100 heat exchanger 200 heat exchanger 200*a* heat exchanger 200*b* heat exchanger 200*c* heat exchanger

210 heat exchange unit 210*a* (first) heat exchange unit 210*aa* (first) heat exchange unit 210*b* (second) heat exchange unit 210*bb* (second) heat exchange unit 213 header 214 header 215 header 231 water-conveyance-side edge 232 pipe-set-side edge 233 intermediate region 234*a* insertion portion 234*b* insertion portion 240 space 253 (third) water conveyance member 255 first ridge 256 second ridge 257 upper surface 300 heat exchanger 310 heat exchange unit 350 water-conveyance structure 1000 heat exchanger 1010 heat exchange unit FP space G gravity ST surface tension

The invention claimed is:

1. A heat exchanger comprising:

a flat tube;

a fin formed in a plate shape and having a plate surface that extends in a longitudinal direction of the fin and such that a width direction of the fin is perpendicular to the longitudinal direction, the fin being located such that the longitudinal direction of the fin coincides with an up/down direction and crosses a tube axis of the flat tube; and a first water conveyance member and a second water conveyance member both provided below the fin, wherein the fin has a pipe set region located at a pipe-set-side edge that is one end edge of the fin in the width direction, the pipe set region having an insertion portion into which the flat tube is inserted, and a water-conveyance region located at a water-conveyance-side edge that is an other end edge of the fin in the width direction, the water-conveyance region having no insertion portion, and wherein the first water conveyance member is provided below the water-conveyance-region in the width direction of the fin, and has a first upper surface that faces a lower end portion of the fin, a first ridge located at one end portion of the first upper surface that is close to the water-conveyance-side edge in a section of the heat exchanger that is perpendicular to the tube axis of the flat tube, and a second ridge located at an other end portion of the first upper surface that is close to the pipe-set-side edge in the section of the heat exchanger that is perpendicular to the tube axis of the flat tube, the second ridge being located below the water-conveyance region of the fin, wherein the second water conveyance member is provided below the pipe set region in the width direction of the fin.

2. The heat exchanger of claim 1, wherein the first water conveyance member is provided such that the first ridge and the second ridge are located below the water-conveyance region.

3. The heat exchanger of claim 1, wherein the second water conveyance member has a second upper surface that faces the lower end portion of the fin, a first ridge located at one end portion of the second upper surface that is close to the water-conveyance-side edge in the section of the heat exchanger that is perpendicular to the tube axis of the flat tube, and a second ridge located at an other end portion of the second upper surface that is close to the pipe-set-side edge in the section of the heat exchanger that is perpendicular to the tube axis of the flat tube, the second ridge being located outward of the pipe-set-side edge of the fin.

4. A heat exchanger unit comprising:

the heat exchanger of claim 1; and a fan configured to send air to the heat exchanger, wherein the heat exchanger is provided such that the water-conveyance region is located upwind of the pipe set region.

5. A heat exchanger unit comprising:

the heat exchanger of claim 1; and a fan configured to send air to the heat exchanger, wherein the heat exchanger is provided such that the pipe set region is located upwind of the water-conveyance region.

6. A refrigeration cycle apparatus provided with the heat exchanger unit of claim 4.

7. The heat exchanger of claim 1, an entirety of the first water conveyance member being disposed below the water-conveyance region.

8. The heat exchanger of claim 1, the first water conveyance member being disposed directly below the water-conveyance region and not being disposed directly below the pipe set region.

9. The heat exchanger of claim 1, the first water conveyance member and the second water conveyance member each being a spacer having a longitudinal axis parallel to the longitudinal direction of the fin and having a sectional shape in the width direction which is rectangular.

10. The heat exchanger of claim 1, the first water conveyance member and the second water conveyance member each being a spacer having a longitudinal axis parallel to the longitudinal direction of the fin and having a sectional shape in the width direction being generally further including a second side surface extending obliquely downwards from and inclined from the second ridge.

11. The heat exchanger of claim 1, the first water conveyance member and the second water conveyance member each being a spacer having a longitudinal axis parallel to the longitudinal direction of the fin and having a sectional shape in the width direction which being generally rectangular further including a first side surface extending obliquely downwards from and inclined from the first ridge.

12. A heat exchanger comprising:

a first heat exchange unit;

a second heat exchange unit provided in series with the first heat exchange unit in a flow direction of air; and a third water conveyance member provided below at least one of the first heat exchange unit and the second heat exchange unit, wherein the first heat exchange unit and the second heat exchange unit each include a flat tube, a fin formed in a plate shape and having a plate surface that extends in a longitudinal direction of the fin and such that a width direction of the fin is perpendicular to the longitudinal direction, the fin being located such that the longitudinal direction of the fin coincides with an up/down direction and crosses a tube axis of the flat tube, wherein the fin has a pipe set region located at a pipe-set-side edge that is one end edge of the fin in the width direction, the pipe set region having an insertion portion into which the flat tube is inserted, and a water-conveyance region located at a water-conveyance-side edge that is an other end edge of the fin in the width direction, the water-conveyance region having no insertion portion, wherein the pipe set region of the first heat exchange unit and the water-conveyance region of the second heat exchange unit are arranged adjacent to each other, with a space interposed between the pipe set region of the first heat exchange unit and the water-conveyance region of the second heat exchange unit, and wherein the third water conveyance member is located below the space, and has a third upper surface that faces a lower end portion of the fin, a first ridge located at an end portion of the third upper surface that is close to the first heat exchange unit in a section of the heat exchanger that is perpendicular to the tube axis, and a second ridge located at another end portion of the third upper surface that is close to the second heat exchange unit, the first ridge of the third water conveyance member is located below the pipe-set-side edge of the first heat exchange unit, and the second ridge of the third water conveyance member is located below the water conveyance region of the second heat exchange unit.

13. A heat exchanger unit comprising:

the heat exchanger of claim 12; and a fan configured to send air to the heat exchanger, wherein the heat exchanger is provided such that the first heat exchange unit is located upwind of the second heat exchange unit.

14. The heat exchanger unit of claim 13, wherein the flat tube of the first heat exchange unit is inclined toward the second heat exchange unit in a direction of gravitational force.

15. A heat exchanger unit comprising:

the heat exchanger of claim 12; and a fan configured to send air to the heat exchanger, wherein the heat exchanger is provided such that the second heat exchange unit is located upwind of the first heat exchange unit.

16. The heat exchanger unit of claim 15, wherein the flat tube of the second heat exchange unit is inclined toward the first heat exchange unit in a direction of gravitational force.

17. A heat exchanger comprising:

a first heat exchange unit;

a second heat exchange unit provided in series with the first heat exchange unit in a flow direction of air; and a third water conveyance member provided below at least one of the first heat exchange unit and the second heat exchange unit, wherein the first heat exchange unit and the second heat exchange unit each include a flat tube, a fin formed in a plate shape and having a plate surface that extends in a longitudinal direction of the fin and such that a width direction of the fin is perpendicular to the longitudinal direction, the fin being located such that the longitudinal direction of the fin coincides with an up/down direction and crosses a tube axis of the flat tube, wherein the fin has a pipe set region located at a pipe-set-side edge that is one end edge of the fin in the width direction, the pipe set region having an insertion portion into which the flat tube is inserted, and a water-conveyance region located at a water-conveyance-side edge that is an other end edge of the fin in the width direction, the water-conveyance region having no insertion portion, wherein the pipe set region of the first heat exchange unit and the water-conveyance region of the second heat exchange unit are arranged adjacent to each other, with a space interposed between the pipe set region of the first heat exchange unit and the water-conveyance region of the second heat exchange unit, and wherein the third water conveyance member is located below the space, and has a third upper surface that faces the lower end portion of the fin, and a first ridge located at an end portion of the third upper surface that is close to the first heat exchange unit in the section of the heat exchanger that is perpendicular to the tube axis, the first ridge being located below the space.

* * * * *